US011298947B2

(12) United States Patent
Shimizu et al.

(10) Patent No.: US 11,298,947 B2
(45) Date of Patent: Apr. 12, 2022

(54) INK CONTAINER

(71) Applicant: SEIKO EPSON CORPORATION, Tokyo (JP)

(72) Inventors: Yoshiaki Shimizu, Matsumoto (JP); Tadahiro Mizutani, Shiojiri (JP); Taku Ishizawa, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/006,302

(22) Filed: Aug. 28, 2020

(65) Prior Publication Data

US 2021/0060960 A1 Mar. 4, 2021

(30) Foreign Application Priority Data

Aug. 29, 2019 (JP) ..... JP2019-156429

(51) Int. Cl.
*B41J 2/175* (2006.01)

(52) U.S. Cl.
CPC ..... *B41J 2/17523* (2013.01); *B41J 2/17553* (2013.01)

(58) Field of Classification Search
CPC ..... B41J 2/175; B41J 2/17523; B41J 2/17553
See application file for complete search history.

(56) References Cited

U.S. PATENT DOCUMENTS

2016/0200110 A1* 7/2016 Matsushita ..... B41J 2/18 347/85

FOREIGN PATENT DOCUMENTS

| | | |
|---|---|---|
| JP | H01-130958 U | 9/1989 |
| JP | H06-183449 A | 7/1994 |
| JP | 2019-051605 A | 4/2019 |

* cited by examiner

*Primary Examiner* — Anh T Vo
(74) *Attorney, Agent, or Firm* — Oliff PLC

(57) ABSTRACT

An ink container includes: a container body that contains ink; and an ink outlet forming portion that has an ink outlet. The container body includes a first connection portion provided around an opening. The ink outlet forming portion includes a second connection portion connectable to the first connection portion. The first connection portion includes a first screw forming portion provided on an outer surface. The second connection portion includes a second screw forming portion provided on an inner surface and configured to be brought into thread engagement with the first screw forming portion. The container body and the ink outlet forming portion include a stopper located inside an outer circumference of the second connection portion in a radial direction, the center of which is a center axis of the first connection portion and the second connection portion.

7 Claims, 7 Drawing Sheets

INK CONTAINER

The present application is based on, and claims priority from JP Application Serial Number 2019-156429, filed Aug. 29, 2019, the disclosure of which is hereby incorporated by reference herein in its entirety.

BACKGROUND

1. Technical Field

Embodiments of the present disclosure relate to an ink container that contains ink.

2. Related Art

An ink container of related art, an example of which is an ink bottle, includes a container body portion, which is an example of a container body that is able to contain ink, and an ink outlet forming portion, in which an ink outlet is formed, for example, as disclosed in JP-A-2019-051605. The ink outlet forming portion is engaged with the container body portion by screw thread engagement, and disconnection from the container body portion is restricted by a ratchet mechanism.

A ratchet mechanism permits rotation in a direction in which pawls formed on a container body portion climb across teeth formed on an ink outlet forming portion, and restricts rotation in a direction in which the pawls are caught on the teeth. The pawls are formed on the outer circumferential surface of the container body portion. The teeth are located outside the pawls in the radial direction. For this reason, if a ratchet mechanism is provided, disadvantageously, size in the radial direction will increase.

SUMMARY

An ink container according to a certain aspect of the present disclosure includes: a container body that contains ink; and an ink outlet forming portion that has an ink outlet; wherein the container body includes a first connection portion provided around an opening, the ink outlet forming portion includes a second connection portion connectable to the first connection portion, the first connection portion includes a first screw forming portion provided on an outer surface, the second connection portion includes a second screw forming portion provided on an inner surface and configured to be brought into thread engagement with the first screw forming portion, and the container body and the ink outlet forming portion include a stopper located inside an outer circumference of the second connection portion in a radial direction, the center of which is a center axis of the first connection portion and the second connection portion.

DESCRIPTION OF EXEMPLARY EMBODIMENTS

First Embodiment

With reference to the accompanying drawings, an ink container according to a first embodiment will now be explained. The ink container is, for example, a container that contains ink to be supplied to an ink jet printer that performs printing on a medium such as paper.

In the figures, based on an assumption that that an ink container 11 is placed in a storage position on a horizontal plane, the Z axis represents the direction of gravity, and the X axis and the Y axis represent the directions along the horizontal plane. The X, Y, and Z axes are orthogonal to one another.

Figure 1:
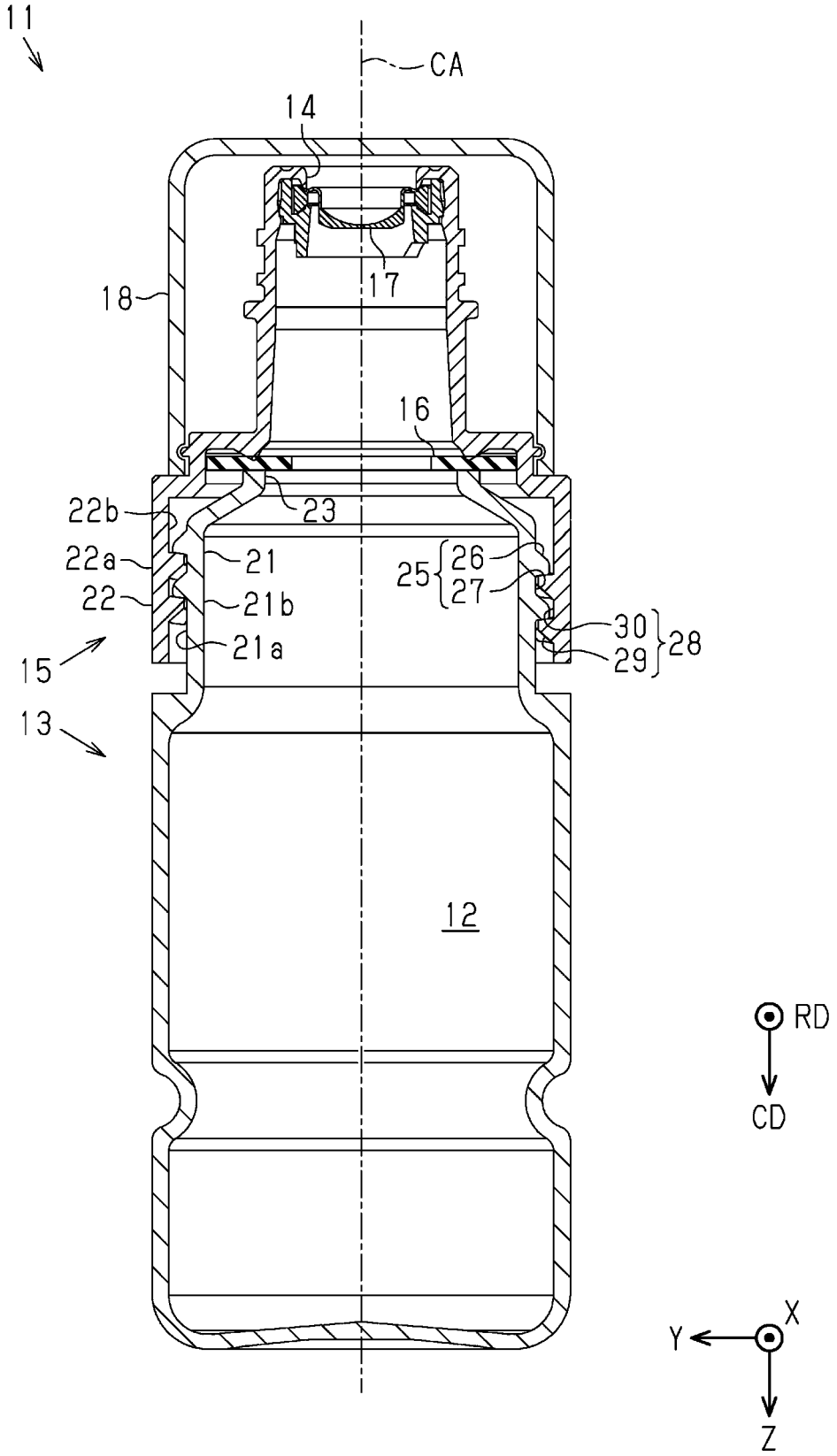
FIG. 1 is a sectional view of an ink container according to a first embodiment.

As illustrated in FIG. 1, the ink container 11 includes a container body 13, which has a container space 12 for containing ink, and an ink outlet forming portion 15, which has an ink outlet 14. The ink outlet 14 enables the ink contained in the container space 12 to flow out. The ink container 11 may include a seal 16 for closing the clearance between the container body 13 and the ink outlet forming portion 15, a valve 17 provided in the ink outlet 14, and a cap 18 for covering the ink outlet 14. The valve 17 according to the present embodiment is made of an elastic member such as a silicon film having a cut. The cut opens to enable the ink to flow out.

When the ink container 11 is in the storage position illustrated in FIG. 1, the ink outlet forming portion 15 is attached to the upper portion of the container body 13. The storage position is an orientation in which the ink outlet 14 is located over the container space 12 and in which a center axis CA going through the center of the ink outlet 14 is parallel to the Z axis. The ink outlet forming portion 15 is connected to the container body 13 in a connection direction CD, which is parallel to the center axis CA. The connection direction CD in the storage position is a direction parallel to the Z axis and may be referred to as a direction toward the bottom from the top. The ink container 11 is turned upside down to change from the storage position into a supply position and thus becomes able to supply ink to a printer that is not illustrated. The supply position is an orientation in which the ink outlet 14 is located under the container space 12 and in which the ink contained in the container space 12 is able to flow out through the ink outlet 14.

Coupling the ink outlet forming portion 15 to the container body 13 forms the ink container 11. The container body 13 includes a first connection portion 21. The ink outlet forming portion 15 includes a second connection portion 22. Each of the first connection portion 21 and the second connection portion 22 has a cylindrical shape the center of which is the center axis CA. The first connection portion 21 is provided around an opening 23. In other words, the opening 23 is configured by a first inner surface 21*b* that is the inner surface of the first connection portion 21.

The distance from the center axis CA to a first outer surface 21*a*, which means the outer diameter of the first connection portion 21, is less than the distance from the center axis CA to a second inner surface 22*b*, which means the inner diameter of the second connection portion 22. Therefore, the second connection portion 22 is provided outside the first connection portion 21 in a radial direction RD, the center of which is the center axis CA, in such a way as to be connectable to the first connection portion 21. The second connection portion 22 connected to the first connection portion 21 covers the opening 23.

The first connection portion 21 includes a first screw forming portion 25 provided on the first outer surface 21*a*. The first screw forming portion 25 includes a first thread 26, which protrudes outward in the radial direction RD from the first outer surface 21*a*, and a first root 27, which is adjacent to the first thread 26 in the connection direction CD. The first thread 26 and the first root 27 are formed in a spiral shape around the center axis CA. That is, the center axis CA according to the present embodiment is the center axis of the first screw forming portion 25.

The second connection portion 22 includes a second screw forming portion 28 provided on the second inner surface 22*b*. The second screw forming portion 28 is able to be brought into thread engagement with the first screw forming portion 25. The second screw forming portion 28 includes a second thread 29, which protrudes inward in the radial direction RD from the second inner surface 22*b*, and a second root 30, which is adjacent to the second thread 29 in the connection direction CD. The second thread 29 according to the present embodiment is provided discontinuously along a virtual spiral around the center axis CA. That is, the center axis CA according to the present embodiment is the center axis of the second screw forming portion 28, too.

Figure 2:
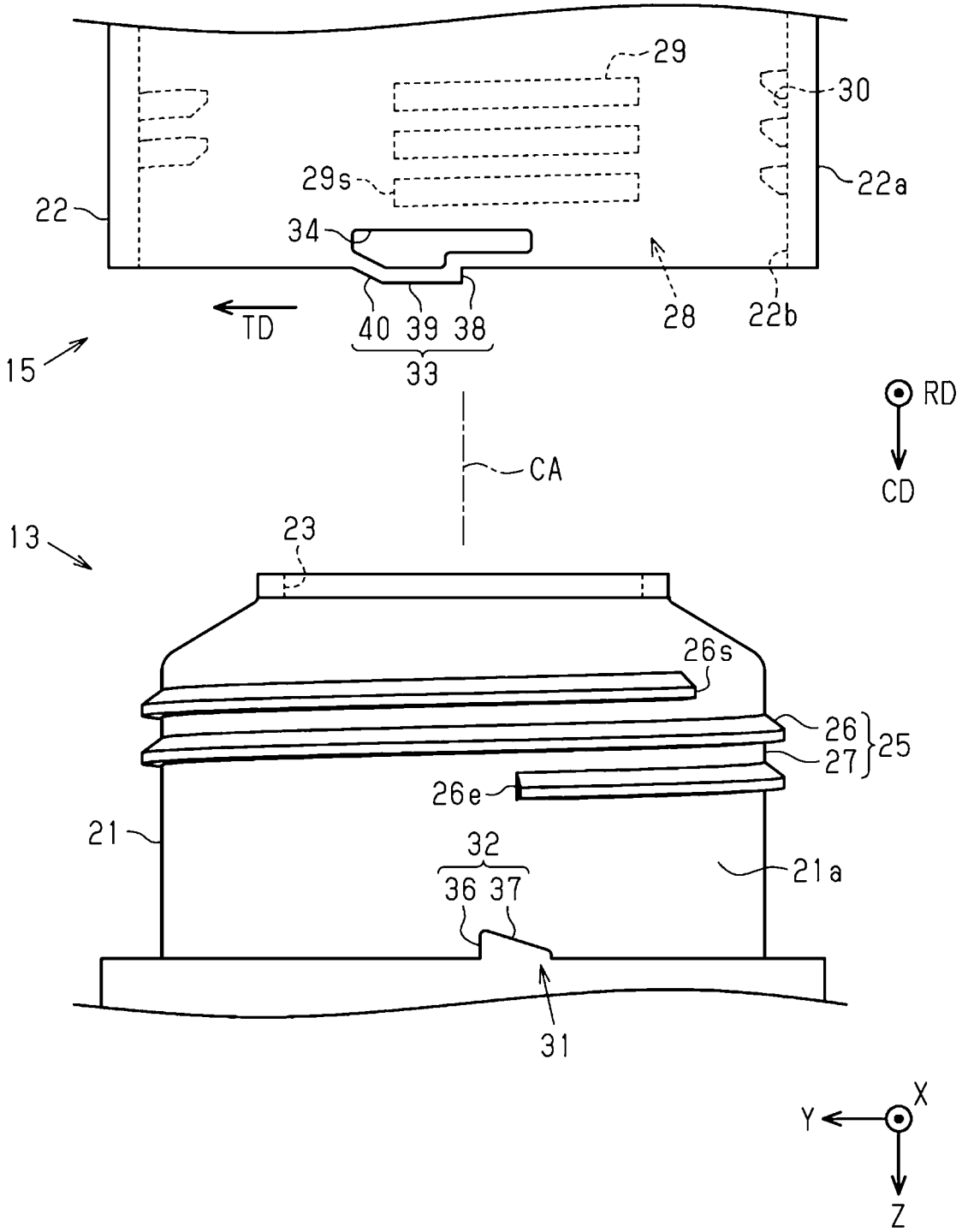
FIG. 2 is a partial side view of a part of the ink container according to the first embodiment shown in a disconnected state.

As illustrated in FIG. 2, the ink outlet forming portion 15 is rotated with respect to the container body 13 in a screw tightening direction TD, the center of which is the center axis CA. Due to this tightening rotation, the second screw forming portion 28 engages with the first screw forming portion 25 to be connected in the connection direction CD. In the present embodiment, the screw tightening direction TD is defined as the clockwise direction when the ink outlet forming portion 15 is viewed from the ink outlet 14.

Figure 3:
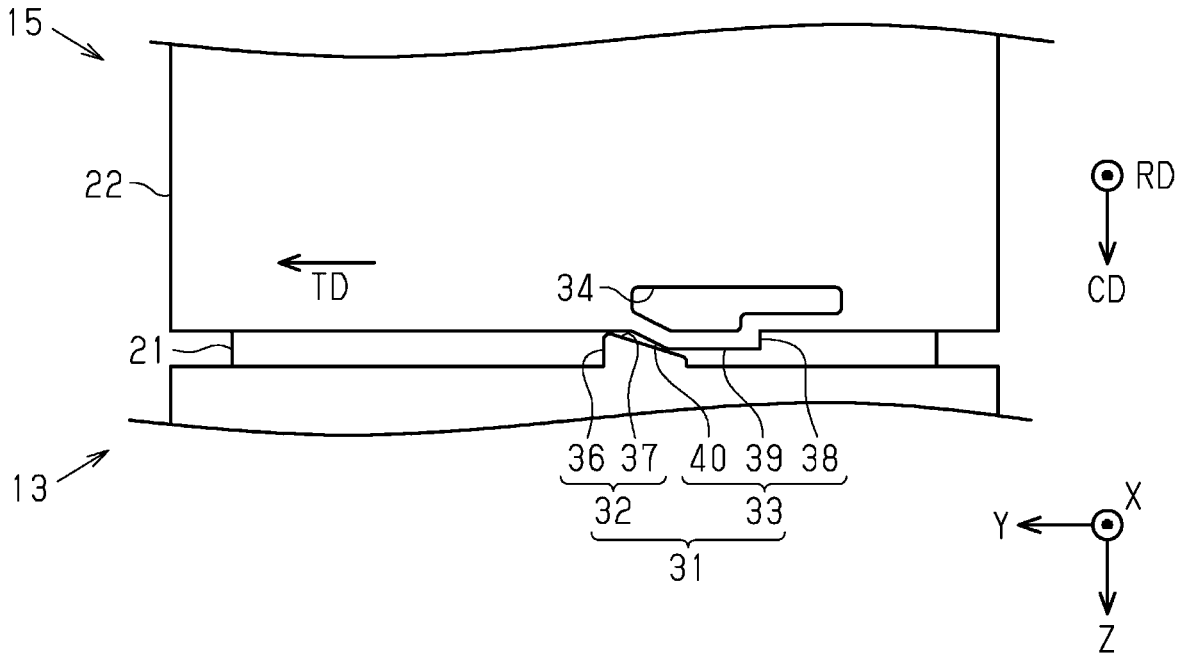
FIG. 3 is a partial side view of the ink container according to the first embodiment.

As illustrated in FIG. 3, the container body 13 and the ink outlet forming portion 15 include a first stopper 31. The first stopper 31 includes a first convex portion 32, which is provided on the first connection portion 21, and a second convex portion 33, which is provided on the second connection portion 22.

Figure 4:
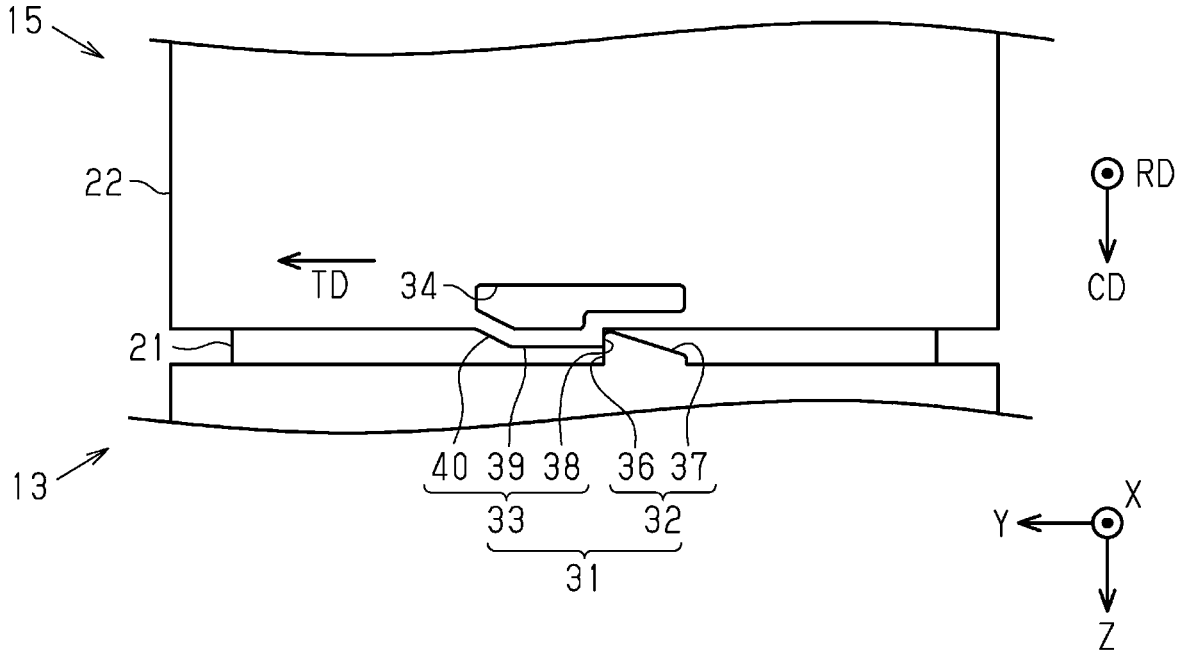
FIG. 4 is a partial side view of the ink container according to the first embodiment.

As illustrated in FIG. 4, the second convex portion 33 is able to engage with the first convex portion 32. In the ink outlet forming portion 15, a through hole 34 going through the second connection portion 22 in the radial direction RD may be provided at an opposite position relative to the second convex portion 33 in the connection direction CD. In the screw tightening direction TD, the size of the through hole 34 may be larger than the size of the second convex portion 33. The through hole 34 may be adjacent to the first convex portion 32 in the connection direction CD when in a state of engagement of the first convex portion 32 and the second convex portion 33.

As illustrated in FIG. 2, the first convex portion 32 is provided at a position of the distal end of the first connection portion 21 in the connection direction CD in such a way as to protrude from the first outer surface 21*a* in the radial direction RD. The position where the first convex portion 32 is provided is more distant from the opening 23 in the connection direction CD than the first screw forming portion 25. Therefore, the distance from the opening 23 to the first convex portion 32 in the connection direction CD is greater than the distance from the opening 23 to a first termination end 26*e* of the first thread 26. The first convex portion 32 includes a first engagement surface 36, which is parallel to the radial direction RD and the connection direction CD, and a first sloped surface 37, which is continuous to the first engagement surface 36. The first engagement surface 36 is located ahead of the first sloped surface 37 in the screw tightening direction TD and is oriented toward the screw tightening direction TD. The first sloped surface 37 is an upslope coming closer to the first engagement surface 36 and the opening 23 as viewed toward the screw tightening direction TD.

The second convex portion 33 is provided on the distal end of the second connection portion 22 in the connection direction CD in such a way as to protrude in the connection direction CD. Therefore, the distance from the ink outlet 14 to the second convex portion 33 in the connection direction CD is greater than the distance from the ink outlet 14 to a second start end 29*s* of the second thread 29. The second convex portion 33 includes a second engagement surface 38, a flat surface 39 adjacent thereto, and a second sloped surface 40 adjacent thereto in the screw tightening direction TD.

The second engagement surface 38 is parallel to the radial direction RD and the connection direction CD and is oriented in a direction that is the opposite of the screw tightening direction TD. The flat surface 39 is a surface that is continuous from the second engagement surface 38 to the second sloped surface 40. The second sloped surface 40 is an upslope coming closer to the ink outlet 14 as viewed toward the screw tightening direction TD.

The first stopper 31 is located inside the outer circumference of the second connection portion 22 in the radial direction RD. That is, in the radial direction RD, the distance from the center axis CA to the outer end of the first convex portion 32 and the distance from the center axis CA to the outer end of the second convex portion 33 are not greater than the distance from the center axis CA to a second outer surface 22*a* of the second connection portion 22. More specifically, the distance from the center axis CA to the second outer surface 22*a* is equal to a length obtained by extending a virtual line segment from the center axis CA to the second screw forming portion 28 in the radial direction RD until reaching the second outer surface 22*a*.

The operation of the present embodiment will now be explained.

As illustrated in FIG. 2, the ink outlet forming portion 15 is rotated in the screw tightening direction TD from a state of alignment of the second start end 29*s* of the second screw forming portion 28 with a first start end 26*s* of the first screw forming portion 25. As a result of this tightening rotation, the second screw forming portion 28 engages with the first screw forming portion 25.

As illustrated in FIG. 3, in the process of rotation of the ink outlet forming portion 15 in the screw tightening direction TD, the second convex portion 33 collides with the first convex portion 32. That is, the second sloped surface 40 of the second convex portion 33 collides with the first sloped surface 37 While causing the deformation of the second connection portion 22 such that the through hole 34 yields, the second convex portion 33 climbs over the first convex portion 32.

As illustrated in FIG. 4, the second convex portion 33 having climbed over the first convex portion 32 is in engagement with the first convex portion 32 due to the contact of the second engagement surface 38 with the first engagement surface 36. The first convex portion 32 and the second convex portion 33 that are in an engaged state are adjacent to each other in the screw tightening direction TD, and the second convex portion 33 is located ahead of the first convex portion 32 in the screw tightening direction TD. That is, since the first convex portion 32 does not allow the second convex portion 33 to move in the direction that is the opposite of the screw tightening direction TD, the first stopper 31 restricts the rotation of the ink outlet forming portion 15 in the direction that is the opposite of the screw tightening direction TD.

The effects of the present embodiment will now be explained.

(1) The first stopper 31 is located inside the outer circumference of the second connection portion 22, on which the second screw forming portion 28 is provided. Therefore, as compared with a case where the first stopper 31 is provided outside the outer circumference of the second connection portion 22 in the radial direction RD, it is possible to prevent an increase in the size of the ink container 11 in the radial direction RD.

(2) The second convex portion 33 of the first stopper 31, in the ink outlet forming portion 15, is provided on the distal end in the connection direction CD. This structure makes is easier to check the state of engagement of the second convex portion 33 of the ink outlet forming portion 15 with the first convex portion 32 of the container body 13 from outside.

(3) The second connection portion 22, on which the second convex portion 33 is provided, deforms easily because the through hole 34 is provided. Therefore, when the ink outlet forming portion 15 is connected to the container body 13 by thread engagement of the second screw forming portion 28 with the first screw forming portion 25, the deformation makes it easier for the second convex portion 33 to climb over the first convex portion 32, resulting in smooth engagement of the first convex portion 32 and the second convex portion 33 with each other.

Second Embodiment

Next, with reference to the accompanying drawings, an ink container according to a second embodiment will now be explained. The second embodiment is different from the first embodiment in terms of the structure of the stopper. Except for this difference, the second embodiment is almost the same as the first embodiment. Therefore, the same reference numerals are assigned to the same parts of the structure, and an explanation of the same parts is omitted.

Figure 5:
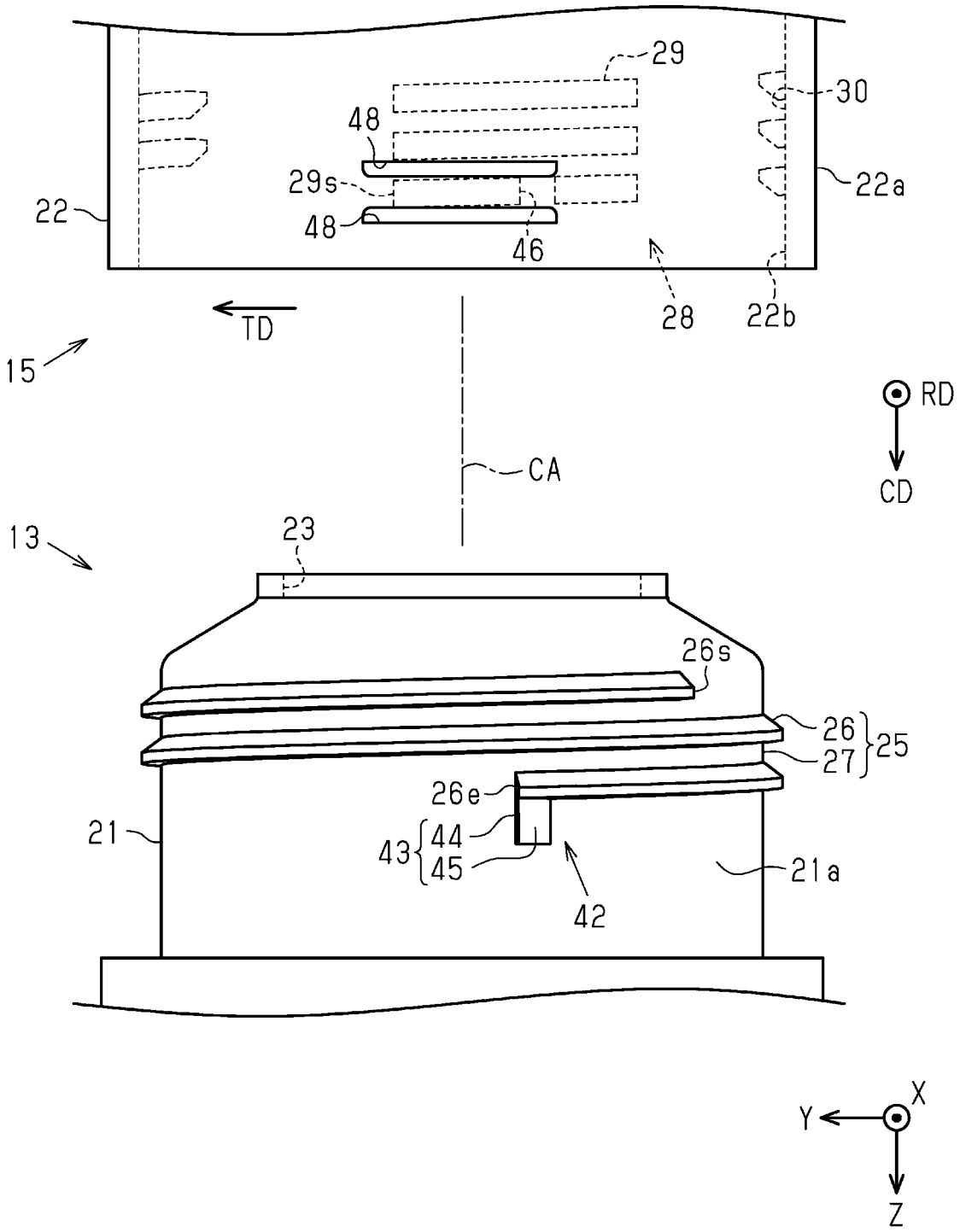
FIG. 5 is a partial side view of a part of an ink container according to a second embodiment shown in a disconnected state.

As illustrated in FIG. 5, a second stopper 42 includes a third convex portion 43, which is provided at the first screw forming portion 25, and the second thread 29, which is able to engage with the third convex portion 43. The height of the third convex portion 43 is not greater than the height of the first thread 26 of the first screw forming portion 25 in the radial direction RD.

Figure 7:
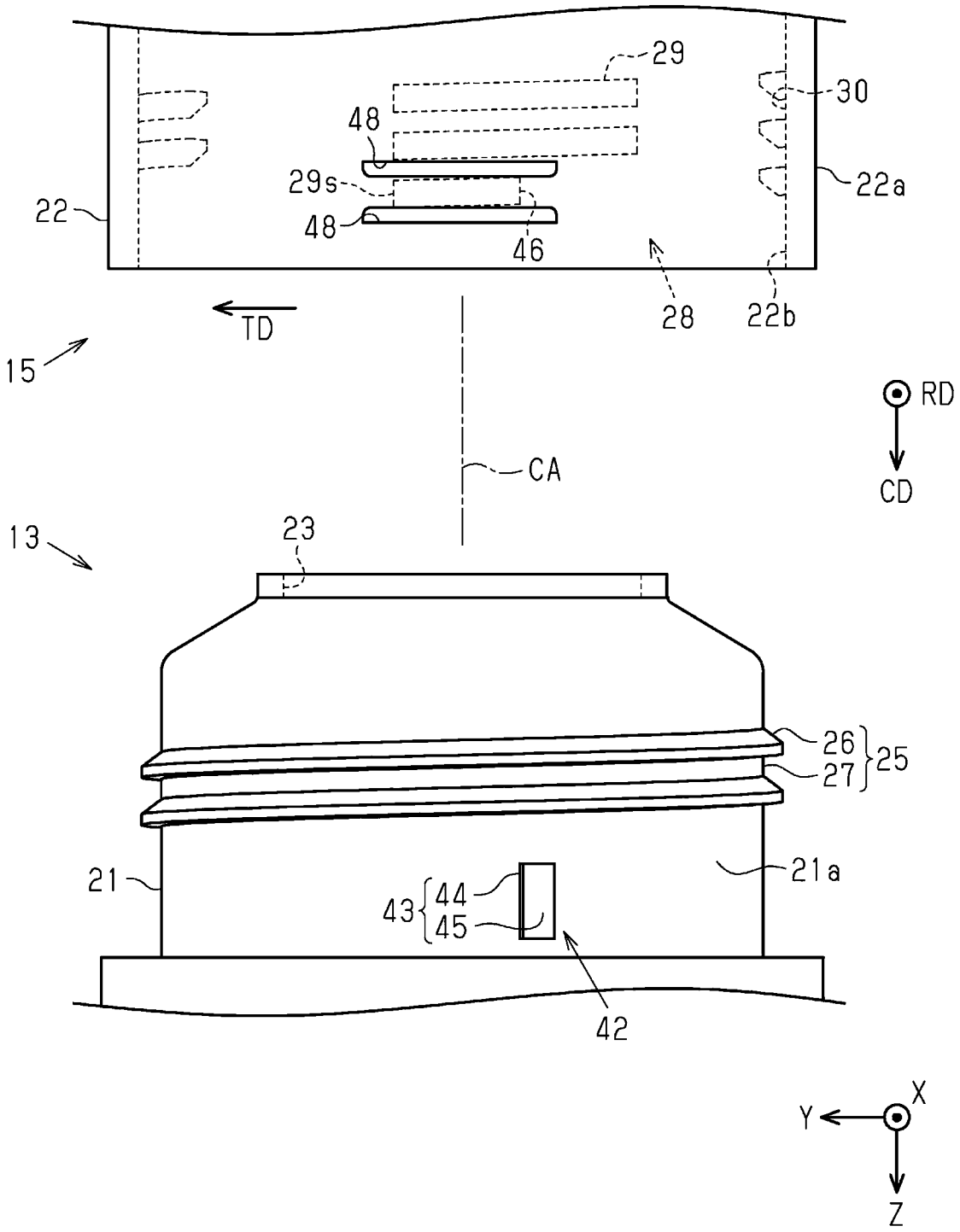
FIG. 7 is a partial exploded side view of a part of the ink container shown in a disconnected state.

The third convex portion 43 is provided at the first root 27 in such a way as to protrude from the first outer surface 21*a* in the radial direction RD. More specifically, as illustrated in FIG. 5, the third convex portion 43 is provided in such a way as to intersect with the first root 27, along which the second thread 29 passes when the second screw forming portion 28 is screwed onto the first screw forming portion 25. That is, the first root 27 is a path of the second thread 29. As illustrated in FIG. 7, the third convex portion 43 may be further provided in such a way as to intersect with the first root 27 at a virtually extended position as long as the position is on the path of the second thread 29.

Figure 6:
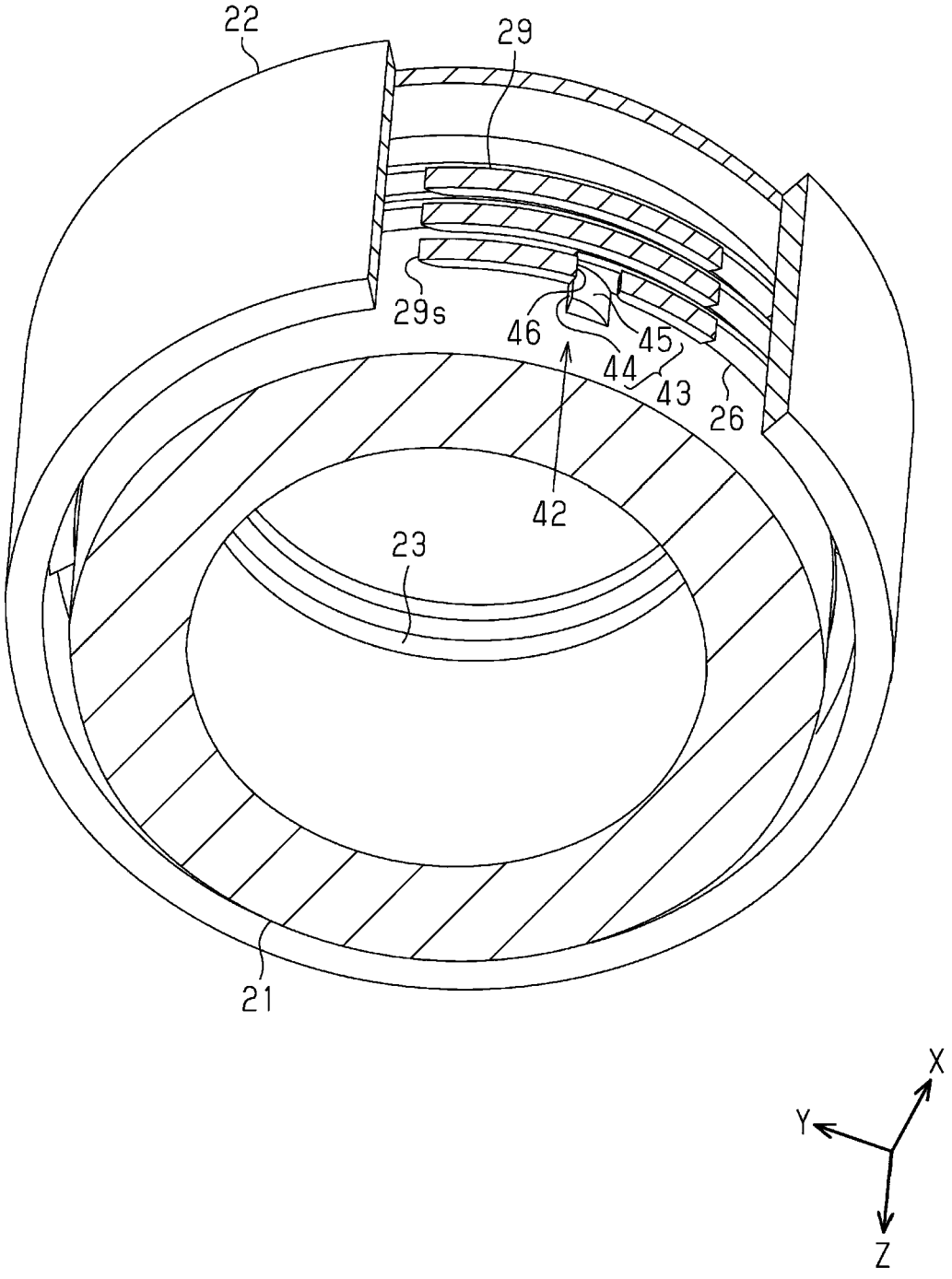
FIG. 6 is a partial sectional perspective view of a second thread in engagement with a third convex portion.

The third convex portion 43 illustrated in FIG. 7 is provided on the first outer surface 21*a* at the opposite position by 180 degrees in the radial direction RD in relation to the third convex portion 43 illustrated in FIG. 5. In the present embodiment, as illustrated in FIG. 6, the second thread 29 is formed discontinuously at the positions of division into four equal parts in the circumferential direction along the second inner surface 22*b* of the second connection portion 22. Therefore, the second thread 29 becomes hooked on both of the third convex portion 43 illustrated in FIG. 5 and the third convex portion 43 illustrated in FIG. 7. This double engagement enhances the function of stopping rotation in the screw loosening direction.

The third convex portion 43 may be provided in such a way as to immediately adjoin the first termination end 26*e* of the first thread 26 as illustrated in FIG. 5. Moreover, in FIG. 7, the third convex portion 43 is provided on the path of the second thread 29 at a distance from the first thread 26. The reason is as follows. It is unnecessary to form the first thread 26 up to the position of adjoining the third convex portion 43 illustrated in FIG. 7 as long as the first screw forming portion 25 and the second screw forming portion 28 are in engagement with each other at a −Z directional region above the third convex portion 43 illustrated in FIG. 7 when in the storage position, and, in addition, as long as the second thread 29 is hooked on the third convex portion 43 illustrated in FIG. 5.

The third convex portion 43 includes a third engagement surface 44, which is parallel to the radial direction RD and the connection direction CD, and a third sloped surface 45, which is continuous to the third engagement surface 44. The third engagement surface 44 is located ahead of the third sloped surface 45 in the screw tightening direction TD and is oriented toward the screw tightening direction TD. The third sloped surface 45 is a slope going away from the first outer surface 21*a* in the radial direction RD as viewed toward the screw tightening direction TD.

The second thread 29 includes a fourth engagement surface 46, which is able to engage with the third engagement surface 44. The fourth engagement surface 46 is parallel to the radial direction RD and the connection direction CD and is oriented in the direction that is the opposite of the screw tightening direction TD.

The second stopper 42 is located inside the outer circumference of the second connection portion 22 in the radial direction RD. That is, in the radial direction RD, the distance from the center axis CA to the outer end of the third convex portion 43 and the distance from the center axis CA to the second inner surface 22*b* on which the second thread 29 is formed are not greater than the distance from the center axis CA to the second outer surface 22*a*.

In the ink outlet forming portion 15, a slit(s) 48 going through the second connection portion 22 in the radial direction RD is provided. The slit 48 may be provided at both sides adjacent to the fourth engagement surface 46 in the connection direction CD. The slit 48 may be provided at the second root 30 such that the second thread 29 is located therebetween in the connection direction CD. The leading portion of the slit 48 may be located ahead of the second start end 29*s* of the second thread 29 in the screw tightening direction TD, and the trailing portion of the slit 48 may be located behind the fourth engagement surface 46 in the screw tightening direction TD.

The operation of the present embodiment will now be explained.

As illustrated in FIG. 5, the ink outlet forming portion 15 is rotated in the screw tightening direction TD from a state of alignment of the second start end 29*s* of the second screw forming portion 28 with the first start end 26*s* of the first screw forming portion 25. As a result of this tightening rotation, the second screw forming portion 28 engages with the first screw forming portion 25. In the process of rotation of the ink outlet forming portion 15 in the screw tightening direction TD, the second start end 29*s* collides with the third convex portion 43, and a part of the second thread 29 climbs over the third convex portion 43. The second start end 29*s* may have a sloped surface along the sloped surface of the third convex portion 43 so as to make it easier to climb over the third convex portion 43. As illustrated in FIG. 6, of the second thread 29, the one that is closest to the container body 13 in the connection direction CD has a split structure, with a recess formed therebetween. The third convex portion 43 fits into the recess. By this means, the third convex portion 43 engages with the fourth engagement surface 46. However, of the second thread 29 having such a split structure, the portion behind the recess in the screw tightening direction TD may be omitted.

As illustrated in FIG. 6, the third convex portion 43 engages with the second thread 29 by contact of the fourth engagement surface 46 with the third engagement surface 44. The trailing portion of the slit 48 behind the leading portion in the screw tightening direction TD is adjacent to the third convex portion 43 in the connection direction CD when in a state of engagement of the third convex portion 43 with the second thread 29. It is possible to impart elasticity to, of the second connection portion 22, the portion where the second thread 29 is provided as long as there is at least one slit 48 on either one of two positions between which the second thread 29 is provided in the connection direction CD. However, it will be advantageous if the slit 48 is provided on both of two positions between which the second thread 29 is provided in the connection direction CD because, with this structure, it is possible to impart greater elasticity to the second connection portion 22.

The third convex portion 43 and the second thread 29 that are in an engaged state are adjacent to each other in the screw tightening direction TD, and the fourth engagement surface 46 is located ahead of the third convex portion 43 in the screw tightening direction TD. That is, since the third convex portion 43 does not allow the second thread 29 to move in the direction that is the opposite of the screw tightening direction TD, the second stopper 42 restricts the rotation of the ink outlet forming portion 15 in the direction that is the opposite of the screw tightening direction TD.

The effects of the present embodiment will now be explained.

(4) The second stopper 42 includes the third convex portion 43, which is provided at the first screw forming portion 25, and the second thread 29, which is provided in the second screw forming portion 28. The second thread 29 engages with the third convex portion 43. Since the second stopper 42 is located inside the second connection portion 22 and is enclosed by the second connection portion 22, the disengagement of the second thread 29 and the third convex portion 43 from each other does not occur easily.

(5) The third convex portion 43 is provided in such a way as to intersect with the path of the second thread 29 passing along the first root 27 when the second screw forming portion 28 is screwed onto the first screw forming portion 25. Therefore, it is possible to bring the second thread 29 into engagement with the third convex portion 43 by screwing the second screw forming portion 28 onto the first screw forming portion 25, thereby restricting the rotation of the second screw forming portion 28 in the direction that is the opposite of the screw tightening direction TD.

(6) Since the ink outlet forming portion 15 has the slit 48, it is easier to cause elastic deformation as compared with a case where the slit 48 is not provided. Therefore, when the ink outlet forming portion 15 is connected to the container body 13 by thread engagement of the second screw forming portion 28 with the first screw forming portion 25, the deformation makes it easier for the second thread 29 to climb over the third convex portion 43, resulting in smooth engagement of the third convex portion 43 and the second thread 29 with each other.

(7) The leading portion of the slit 48 is located ahead of the second thread 29 in the screw tightening direction TD. The trailing portion of the slit 48 is adjacent to the third convex portion 43 in the connection direction CD when in a state of engagement of the third convex portion 43 with the second thread 29. This means that the slit 48 has a length that is at least from the leading end of the second thread 29 in the screw tightening direction TD to the portion configured to engage with the third convex portion 43. The ink outlet forming portion 15 has the portion where the second thread 29 configured to climb over the third convex portion 43 is provided, and, because of the slit structure explained above, the elastic deformation of this portion occurs easily. This makes it easier for the second thread 29 to climb over the third convex portion 43.

The foregoing embodiments may be modified as described below. The foregoing embodiments and the following modification examples may be combined with one another as long as they are not technically contradictory to one another.

Figure 8:
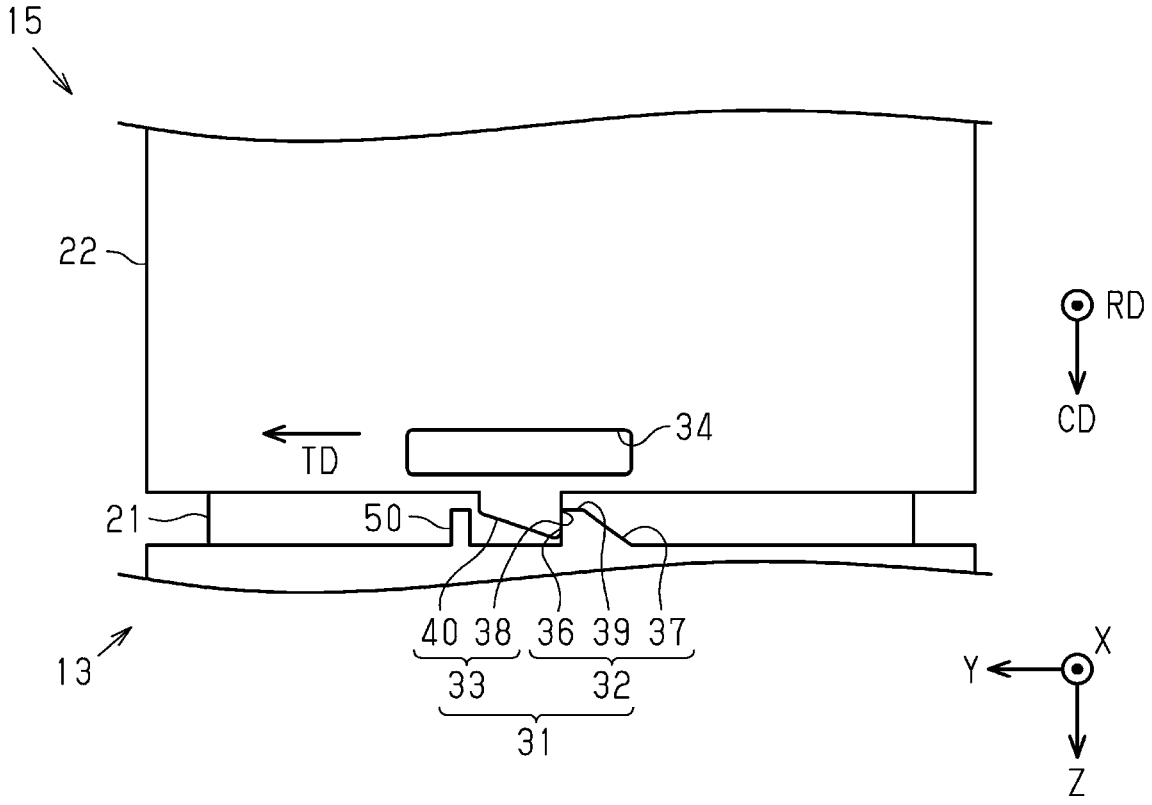
FIG. 8 is a partial side view of the ink container according to a modification example.

- The ink container 11 may be provided with either one of the third convex portion 43 illustrated in FIG. 5 and the third convex portion 43 illustrated in FIG. 7.
- As illustrated in FIG. 8, the flat surface 39 of the first stopper 31 may be provided in the first convex portion 32. That is, the flat surface 39 may be a surface that is continuous from the first sloped surface 37 to the first engagement surface 36. The first connection portion 21 may include a restriction portion 50 that restricts the movement, in the screw tightening direction TD, of the second convex portion 33 engaged with the first convex portion 32.
- The ink container 11 may include a plurality of stoppers. For example, the ink container 11 may include a plurality of first stoppers 31 provided at intervals in the screw tightening direction TD, or a plurality of second stoppers 42. The ink container 11 may include both the first stopper(s) 31 and the second stopper(s) 42.
- The length of the slit 48 in the screw tightening direction TD may be less than the length from the second start end 29*s* of the second thread 29 to the fourth engagement surface 46. In the screw tightening direction TD, the leading portion of the slit 48 may be located at the same position as the second start end 29*s* or behind the second start end 29*s*. In the screw tightening direction TD, the trailing end of the slit 48 may be located ahead of the fourth engagement surface 46.
- The slit 48 may be provided on at least one of two positions between which the second thread 29 is provided in the connection direction CD. The ink outlet forming portion 15 may be provided with one slit 48. The slit 48 of the ink outlet forming portion 15 may be omitted.

The through hole 34 of the ink outlet forming portion 15 may be omitted.

Any kind of ink may be chosen as long as it is possible to perform printing on a medium by adhesion of the ink to the medium. For example, "ink" encompasses a substance that is made as a result of dissolution, dispersion, or mixture of particles of a functional material made of a solid such as pigment, metal particles, or the like into/with a solvent, and encompasses various kinds of liquid composition such as water-based ink, oil-based ink, gel ink, hot melt ink, and the like.

Technical concepts that will be understood from the foregoing embodiments and modification examples, and the operational effects thereof, are described below.

(A) An ink container includes: a container body that contains ink; and an ink outlet forming portion that has an ink outlet; wherein the container body includes a first connection portion provided around an opening, the ink outlet forming portion includes a second connection portion connectable to the first connection portion, the first connection portion includes a first screw forming portion provided on an outer surface, the second connection portion includes a second screw forming portion provided on an inner surface and configured to be brought into thread engagement with the first screw forming portion, and the container body and the ink outlet forming portion include a stopper located inside an outer circumference of the second connection portion in a radial direction, the center of which is a center axis of the first connection portion and the second connection portion.

In this structure, the stopper is located inside the outer circumference of the second connection portion, on which the second screw forming portion is provided. Therefore, as compared with a case where the stopper is provided outside the outer circumference of the second connection portion in the radial direction, it is possible to prevent an increase in the size of the ink container in the radial direction.

(B) In the ink container, the ink outlet forming portion may be connected to the container body in a connection direction parallel to the center axis, and the stopper may include a first convex portion provided on the first connection portion, and includes a second convex portion provided on a distal end of the second connection portion in the connection direction and configured to engage with the first convex portion.

In this structure, the second convex portion of the stopper, in the ink outlet forming portion, is provided on the distal end in the connection direction. Therefore, it is easier to check the state of engagement of the second convex portion of the ink outlet forming portion with the first convex portion of the container body from outside.

(C) In the ink outlet forming portion of the ink container, a through hole going through the second connection portion in the radial direction may be provided at an opposite position relative to the second convex portion in the connection direction.

The second connection portion, on which the second convex portion is provided, deforms easily because the through hole is provided in this structure. Therefore, when the ink outlet forming portion is connected to the container body by thread engagement of the second screw forming portion with the first screw forming portion, the deformation makes it easier for the second convex portion to climb over the first convex portion, resulting in smooth engagement of the first convex portion and the second convex portion with each other.

(D) In the ink container, the stopper may include a third convex portion provided at the first screw forming portion and having a height not greater than a height of a first thread of the first screw forming portion in the radial direction, and may include a second thread provided on the second connection portion and configured to engage with the third convex portion.

In this structure, the stopper includes the third convex portion, which is provided at the first screw forming portion, and the second thread, which is provided in the second screw forming portion, and the second thread engages with the third convex portion. Since the stopper is located inside the second connection portion and is enclosed by the second connection portion, the disengagement of the second thread and the third convex portion from each other does not occur easily.

(E) In the ink container, the first screw forming portion may include a first root along which the second thread passes when the second screw forming portion is screwed onto the first screw forming portion, and the third convex portion may be provided in such a way as to intersect with a path of the second thread.

In this structure, the third convex portion is provided in such a way as to intersect with the path of the second thread passing along the first root when the second screw forming portion is screwed onto the first screw forming portion. Therefore, it is possible to bring the second thread into engagement with the third convex portion by screwing the second screw forming portion onto the first screw forming portion, thereby restricting the rotation of the second screw forming portion in the direction that is the opposite of the screw tightening direction.

(F) In the ink container, the ink outlet forming portion may be connected to the container body in a connection direction parallel to the center axis by being rotated with respect to the container body in a screw tightening direction, in the ink outlet forming portion, a slit going through the second connection portion in the radial direction may be provided, and when in a state of engagement of the third convex portion with the second thread, the slit may be provided on at least one of two positions between which the second thread is provided in the connection direction.

In this structure, since the ink outlet forming portion has the slit, it is easier to cause elastic deformation as compared with a case where the slit is not provided. Therefore, when the ink outlet forming portion is connected to the container body by thread engagement of the second screw forming portion with the first screw forming portion, the deformation makes it easier for the second thread to climb over the third convex portion, resulting in smooth engagement of the third convex portion and the second thread with each other.

(G) In the ink container, a leading portion of the slit in the screw tightening direction may be located ahead of the second thread, and a trailing portion of the slit behind the leading portion in the screw tightening direction may be adjacent to the third convex portion in the connection direction when in the state of engagement of the third convex portion with the second thread.

In this structure, the leading portion of the slit is located ahead of the second thread in the screw tightening direction. The trailing portion of the slit is adjacent to the third convex portion in the connection direction when in a state of engagement of the third convex portion with the second thread. This means that the slit has a length that is at least from the leading end of the second thread in the screw tightening direction to the portion configured to engage with the third convex portion. The ink outlet forming portion has the portion where the second thread configured to climb over the third convex portion is provided, and, because of the slit structure explained above, the elastic deformation of this portion occurs easily. This makes it easier for the second thread to climb over the third convex portion.

What is claimed is:

1. An ink container, comprising:

a container body that contains ink; and an ink outlet forming portion that has an ink outlet, wherein the container body includes a first connection portion provided around an opening, the ink outlet forming portion includes a second connection portion connectable to the first connection portion, the first connection portion includes a first screw forming portion provided on an outer surface, the second connection portion includes a second screw forming portion provided on an inner surface and configured to be brought into thread engagement with the first screw forming portion, the container body and the ink outlet forming portion include a stopper located inside an outer circumference of the second connection portion in a radial direction, the center of which is a center axis of the first connection portion and the second connection portion, the ink outlet forming portion is connected to the container body in a connection direction parallel to the center axis, and the stopper includes a first convex portion provided on the first connection portion, and includes a second convex portion provided on a distal end of the second connection portion in the connection direction and configured to engage with the first convex portion.

2. The ink container according to claim 1, wherein in the ink outlet forming portion, a through hole going through the second connection portion in the radial direction is provided at an opposite position relative to the second convex portion in the connection direction.

3. The ink container according to claim 1, wherein the stopper includes a third convex portion provided at the first screw forming portion and having a height not greater than a height of a first thread of the first screw forming portion in the radial direction, and includes a second thread provided on the second connection portion and configured to engage with the third convex portion.

4. The ink container according to claim 3, wherein the first screw forming portion includes a first root along which the second thread passes when the second screw forming portion is screwed onto the first screw forming portion, and the third convex portion is provided in such a way as to intersect with a path of the second thread.

5. The ink container according to claim 3, wherein the ink outlet forming portion is connected to the container body in a connection direction parallel to the center axis by being rotated with respect to the container body in a screw tightening direction, in the ink outlet forming portion, a slit going through the second connection portion in the radial direction is provided, and when in a state of engagement of the third convex portion with the second thread, the slit is provided on at least one of two positions between which the second thread is provided in the connection direction.

6. The ink container according to claim 5, wherein a leading portion of the slit in the screw tightening direction is located ahead of the second thread, and a trailing portion of the slit behind the leading portion in the screw tightening direction is adjacent to the third convex portion in the connection direction when in the state of engagement of the third convex portion with the second thread.

7. An ink container, comprising:

a container body that contains ink; and an ink outlet forming portion that has an ink outlet, wherein the container body includes a first connection portion provided around an opening, the ink outlet forming portion includes a second connection portion connectable to the first connection portion, the first connection portion includes a first screw forming portion provided on an outer surface, the second connection portion includes a second screw forming portion provided on an inner surface and configured to be brought into thread engagement with the first screw forming portion, the container body and the ink outlet forming portion include a stopper located inside an outer circumference of the second connection portion in a radial direction, the center of which is a center axis of the first connection portion and the second connection portion, and the stopper includes a third convex portion provided at the first screw forming portion and having a height not greater than a height of a first thread of the first screw forming portion in the radial direction, and includes a second thread provided on the second connection portion and configured to engage with the third convex portion.

* * * * *